US008024197B2

(12) United States Patent
Saito

(10) Patent No.: US 8,024,197 B2
(45) Date of Patent: Sep. 20, 2011

(54) SAMPLING RATE CONVERSION APPARATUS AND METHOD THEREOF

(75) Inventor: Junichi Saito, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 468 days.

(21) Appl. No.: 12/363,293

(22) Filed: Jan. 30, 2009

(65) Prior Publication Data

US 2009/0240508 A1 Sep. 24, 2009

(30) Foreign Application Priority Data

Mar. 19, 2008 (JP) ..... 2008-071100

(51) Int. Cl.
*G10L 19/00* (2006.01)
*G10L 21/04* (2006.01)

(52) U.S. Cl. ..... 704/500; 704/203; 704/503

(58) Field of Classification Search ..... None
See application file for complete search history.

(56) References Cited

U.S. PATENT DOCUMENTS

| | | | | |
|---|---|---|---|---|
| 5,497,435 | A | 3/1996 | Berger | |
| 6,895,375 | B2 * | 5/2005 | Malah et al. | 704/219 |
| 7,289,963 | B2 | 10/2007 | Iwasaki et al. | |
| 2007/0041438 | A1 | 2/2007 | Mogi et al. | |

FOREIGN PATENT DOCUMENTS

| | | | |
|---|---|---|---|
| JP | 2005-084370 | | 3/2005 |
| JP | 2005084370 | A * | 3/2005 |
| JP | 2006330144 | A * | 12/2006 |

OTHER PUBLICATIONS

Wang, Z. "Predictive fractal interpolation mapping: differential speech coding at low bit rates," Acoustics, Speech, and Signal Processing, 1996. ICASSP-96. Conference Proceedings., 1996 IEEE International Conference on, May 7-10, 1996, on pp. 251-254 vol. 1.*

Maragos, P. "Fractal aspects of speech signals: dimension and interpolation," Acoustics, Speech, and Signal Processing, 1991. ICASSP-91., 1991 International Conference on, Apr. 14-17, 1991, on pp. 417.*

Mackenzie, J. "Using strange attractors to model sound," Doctoral Thesis, 1994.*

Mazel, D. "Using iterated function systems to model discrete sequences," Signal Processing, IEEE Transactions on, Jul. 1992 vol. 40 Issue:7, on pp. 1724-1734.*

* cited by examiner

*Primary Examiner* — Matthew Sked
(74) *Attorney, Agent, or Firm* — Brinks Hofer Gilson & Lione

(57) ABSTRACT

A sampling rate conversion apparatus and a method thereof are provided which increase the sampling rate of a discrete audio signal sampled at a predetermined sampling rate by using a fractal interpolation function (FIF). An audio signal portion formed by a predetermined number of sampling data items is divided into a plurality of interpolation intervals. On the audio signal portion, mapping points are determined. The number of the mapping points is in accordance with the degree of increase in the sampling rate. For the respective interpolation intervals, mapping parameters for performing mapping using the FIF on the mapping points are calculated. In all of the interpolation intervals, the mapping using the FIF is performed on the mapping points with the use of the mapping parameters according to the respective interpolation intervals. Thereby, new sampling data items are generated.

16 Claims, 10 Drawing Sheets

$w_i$: $a_i$, $c_i$, $d_i$, $e_i$, $f_i$

SAMPLING RATE CONVERSION APPARATUS AND METHOD THEREOF

RELATED APPLICATIONS

The present application claims priority to Japanese Patent Application Number 2008-071100, filed Mar. 19, 2008, the entirety of which is hereby incorporated by reference.

BACKGROUND OF THE INVENTION

1. Field of the Invention

The present invention relates to a sampling rate conversion apparatus and a conversion method thereof, particularly to a sampling rate conversion apparatus and a conversion method thereof which increase the sampling rate of a discrete audio signal sampled at a predetermined sampling rate by using a fractal interpolation function (FIF).

2. Description of the Related Art (a) FIF:

In the audio field and the graphics field, a variety of techniques of interpolating between sampling signals have been studied and proposed. The interpolation techniques include an FIF (Fractal Interpolation Function). The FIF is a technique of performing interpolation by mapping into an interpolation interval a signal waveform having a length M times longer than the length of the interpolation interval. The FIF, which is the basis for a rate conversion process according to the present embodiments, will be described below.

As illustrated in FIG. 7, an FIF processing procedure performed with a one-dimensional discrete signal $S=\{(u_n, v_n): n=0, 1, \ldots, N\}$ will be described below. Herein, the signal S is a signal represented by a single-valued function satisfying the following formula.

$$u_0<u_1<\ldots<u_n \tag{1}$$

First, an M+1 number of representative points $P=\{(x_i, y_i): i=1, 2, \ldots, M\}$ (black circles in FIG. 7) are selected from the signal S. Herein, it is assumed that both end points of the signal S are unconditionally selected as the representative points, as shown in the following formula.

Formula 1

$$\begin{pmatrix} u_0 \\ v_0 \end{pmatrix} = \begin{pmatrix} x_0 \\ y_0 \end{pmatrix}, \begin{pmatrix} u_N \\ v_N \end{pmatrix} = \begin{pmatrix} x_M \\ y_M \end{pmatrix} \tag{2}$$

With the M+1 number of the representative points selected, the signal S is divided into an M number of intervals (the first interval to the M-th interval). Hereinafter, the interval defined by two consecutive representative points $[x_{i-1}, x_i]$ will be referred to as the interpolation interval i.

Then, an affine map $w_i$ represented by Equation (3) is applied to map the signal S into each of the M number of the interpolation intervals i (i=0 to M). FIG. 8 illustrates an example in which the signal S is mapped into the interpolation interval i.

Formula 2

$$w_i\begin{pmatrix} x \\ y \end{pmatrix} = \begin{pmatrix} a_i & 0 \\ c_i & d_i \end{pmatrix}\begin{pmatrix} x \\ y \end{pmatrix} + \begin{pmatrix} e_i \\ f_i \end{pmatrix}: i = 1, 2, \ldots, M \tag{3}$$

In the above equation, $w_i$ represents a contraction map for mapping the signal S into the interpolation interval i. It is therefore understood that the signal S provided by the application of the FIF is expressed as a union of contracted images $w_i(S)$ thereof obtained by the contraction map $w_i$ (i=1 to M), as shown in the following formula.

Formula 3

$$S \approx G = \bigcup_{i=1}^{M} w_i(S) \tag{4}$$

In the above formula, G represents an attractor of an Iterated Function System (IFS), and has been known to have a self-affine characteristic.

Meanwhile, Equation (3) includes five unknown parameters $a_i$, $c_i$, $d_i$, $e_i$, and $f_i$ (hereinafter referred to as the mapping parameters). To apply Equation (3) to an actual signal, the five unknown parameters $a_i$, $c_i$, $d_i$, $e_i$, and $f_i$ need to be calculated. Therefore, a constraint represented by the following formula is provided.

Formula 4

$$w_i\begin{pmatrix} u_0 \\ v_0 \end{pmatrix} = \begin{pmatrix} x_{i-1} \\ y_{i-1} \end{pmatrix}, w_i\begin{pmatrix} u_N \\ v_N \end{pmatrix} = \begin{pmatrix} x_i \\ y_i \end{pmatrix}: i = 1, 2, \ldots, M \tag{5}$$

Due to the above-described constraint, end points $T_s$ and $T_e$ of the signal S are mapped onto end points $T_{is}$ and $T_{ie}$ of the interpolation interval i, as indicated by arrows A and B in FIG. 8. With the provision of the above-described constraint, and in consideration of the parameter $d_i$ of the five mapping parameters, which is called a contraction factor, the other four mapping parameters can be respectively expressed as follows.

Formula 5

$$a_i = \frac{x_i - x_{i-1}}{x_M - x_0} \tag{6}$$

$$e_i = \frac{x_M x_{i-1} - x_0 x_i}{x_M - x_0} \tag{7}$$

$$c_i = \frac{y_i - y_{i-1}}{x_M - x_0} - d_i \frac{y_M - y_0}{x_M - x_0} \tag{8}$$

$$f_i = \frac{x_M y_{i-1} - x_0 y_i}{x_M - x_0} - d_i \frac{x_M y_0 - x_0 y_M}{x_M - x_0} \tag{9}$$

In an attempt to highly accurately express a signal provided by the use of the FIF, there arises an issue of how to determine the representative points and the contraction factor. This issue has been called an inverse problem of the FIF, and some methods for solving the issue have been proposed. In the present specification, the inverse problem is solved by the use of a method proposed by Mazel et al. The method will be described below.

(b) Mapping Parameters:

As previously described, with the application of the FIF, the provided signal S is mapped into the respective interpolation intervals. Herein, the contracted image $w_i(S)=[(p_n, q_n): n=0, 1, \ldots, N]$ of the signal S obtained by the contraction map $w_i$ (see FIG. 9) can be expressed as in the following formula.

In FIG. 9, large white circles represent data points on the signal S, and small black circles represent an N number of points on the contracted image $w_i(S)$.

Formula 6

$$\begin{pmatrix} p_n \\ q_n \end{pmatrix} = \begin{pmatrix} a_i \cdot u_n + e_i \\ c_i \cdot u_n + d_i \cdot v_n + f_i \end{pmatrix}; \; n = 0, 1, \ldots, N \tag{10}$$

As described in the foregoing section, in the application of the FIF, there is an issue of how to generate the attractor G in which the provided signal S is highly accurately approximated. This issue can be solved by minimization of the error between a subset S $[x_{i-1}, x_i]$ of the signal S and the contracted image $w_i(S)$. Herein, the error between the subset S $[x_{i-1}, x_i]$ and the contracted image $w_i(S)$ is represented as $E_i$. Then, with the vertical distances between the data points constituting the subset S $[x_{i-1}, x_i]$ and the data points constituting the contracted image $w_i(S)$ added together, as illustrated in FIG. 9, the error $E_i$ can be formulated as in the following formula.

Formula 7

$$E_i = \sum_{n=0}^{N} (c_i \cdot u_n + d_i \cdot v_n + f_i - v_m)^2 \tag{11}$$

$$m = [a_i \cdot u_n + e_i + 0.5] \tag{12}$$

In Equation (12), [•] represents a Gaussian symbol. If Equations (8) and (9) are substituted in Equation (11) and rearranged, the following equations are obtained.

Formula 8

$$E_i = \sum_{n=0}^{N} (\alpha_n \cdot d_i - \beta_n)^2 \tag{13}$$

$$\alpha_n = v_n - \frac{y_M - y_0}{x_M - x_0} u_n - \frac{x_M y_0 - x_0 y_M}{x_M - x_0} \tag{14}$$

$$\beta_n = v_m - \frac{y_i - y_{i-1}}{x_M - x_0} u_n - \frac{x_M y_{i-1} - x_0 y_i}{x_M - x_0} \tag{15}$$

Then, in terms of the contraction factor $d_i$, Equation (13) is minimized on the basis of the least squares criterion. As a result, the contraction factor $d_i$ is provided by the following formula.

Formula 9

$$d_i = \frac{\sum_{n=0}^{N} \alpha_n \beta_n}{\sum_{n=0}^{N} \alpha_n^2} \tag{16}$$

As previously described, if the value of the contraction factor $d_i$ is determined, the remaining four mapping parameters can be uniquely determined. Therefore, if a target signal is entirely constituted by known data points, the inverse problem of the signal can be relatively easily solved, and the signal S can be mapped into the respective interpolation intervals.

As described above, if a target signal is entirely constituted by known data points, the inverse problem of the signal can be relatively easily solved. However, a signal subjected to rate conversion (upsampling) includes unknown data points to be interpolated. Therefore, it is difficult to solve the inverse problem.

In view of the above, a sampling rate conversion method using the FIF has been proposed as a related art, which can solve the inverse problem of a signal subjected to rate conversion (upsampling) and accurately perform rate conversion of converting a low sampling rate signal to a high sampling rate signal (see Japanese Unexamined Patent Application Publication No. 2005-84370).

The related art uses the fact that the mapping parameters of the following Formula 10 for the i-th interpolation interval of an amplified signal $S^k$ having a sampling rate k times higher than the sampling rate of the original signal S can be determined as shown in the following Formula 11 with the use of the parameters $a_i$, $c_i$, $d_i$, $e_i$, and $f_i$ for the i-th interpolation interval of the signal S.

Formula 10

$$\hat{a}_i, \hat{c}_i, \hat{d}_i, \hat{e}_i, \hat{f}_i \tag{17}$$

Formula 11

$$\begin{pmatrix} \hat{a}_i \\ \hat{c}_i \\ \hat{d}_i \\ \hat{e}_i \\ \hat{f}_i \end{pmatrix} = \begin{pmatrix} a_i \\ c_i \\ d_i \\ k \cdot e_i \\ d \cdot f_i \end{pmatrix}; \; i = 1, 2, \ldots, M \tag{18}$$

Herein, the "amplified signal having a sampling rate k times higher" is a signal obtained by a process of multiplying each of the sampling rate and the signal value (the amplitude) of the signal S by k. A specific process will be described below.

As illustrated in FIG. 10, a representative point determination unit 101 determines the representative points $P=\{(x_i, y_i): i=1, 2, \ldots, M\}$ of the signal S (Step 1). Then, a mapping parameter calculation unit 102 determines the mapping parameters $a_i$, $c_i$, $d_i$, $e_i$, and $f_i$ (Step 2).

Then, an amplified signal representative point determination unit 103 multiplies the representative points $P=\{(x_i, y_i): i=1, 2, \ldots, M\}$ of the signal S by k in the directions of a u-axis and a v-axis, to thereby determine the representative points of the amplified signal $S^k$ expressed in the following Formula 12 (Step 3).

$$\hat{P}=\{(\hat{x}_i, \hat{y}_i): i=0, 1, \ldots, M\} \quad \text{Formula 12}$$

Then, an amplified signal mapping parameter calculation unit 104 determines the mapping parameters of the amplified signal $S^k$ expressed in the following Formula 13 (Step 4).

$$\hat{a}_i, \hat{c}_i, \hat{d}_i, \hat{e}_i, \hat{f}_i, \quad \text{Formula 13}$$

Then, an attractor generation unit 105 repeatedly applies a well-known Random Iteration Algorithm (RIA) to generate an attractor $G^k$ expressed in the following Formula 14, in which the amplified signal $S^k$ is approximated (Step 5).

$$G^k=\{(\hat{u}_n, \hat{v}_n): n=0, 1, \ldots, kN\} \quad \text{Formula 14}$$

The generated attractor $G^k$ is k times greater than the attractor of the original signal S. Lastly, therefore, the attractor $G^k$ is multiplied by 1/k (Step 6). That is, if the attractor is calculated by the following Formula 15, the attractor represents a signal having a sampling rate k times higher than the sampling rate of the original signal S.

$$\hat{G}^{k}=\{(\hat{u}_n,\hat{v}_n/k):n=0,1,\ldots,kN\} \quad \text{Formula 15}$$

According to the related art described above, as the number of repetitions of the RIA increases, the attractor converges, and the sampling rate can be multiplied by k with high accuracy. However, the related art requires an increased number of repetitions of the RIA. As a result, there arises an issue of an increase in the throughput and resultant difficulty in achieving real-time processing in an audio DSP (Digital Signal Processor).

SUMMARY OF THE INVENTION

In view of the above issues, the present embodiments may reduce the throughput and multiply the sampling rate by k in a short time with no need for an RIA process.

The present embodiments may enable an audio DSP to increase the sampling rate through real-time processing.

The present embodiments may provide a sampling rate conversion apparatus and a computerized conversion method thereof, performed via a processor, which increase the sampling rate of a discrete audio signal sampled at a predetermined sampling rate by performing mapping using a fractal interpolation function (FIF).

Sampling Rate Conversion Method:

A sampling rate conversion method according to an aspect of the present embodiments may include first to fourth steps. The first step may divide an audio signal portion formed by a predetermined number of sampling data items into a plurality of interpolation intervals. The second step may determine, on the audio signal portion, mapping points, the number of which is in accordance with the degree of increase in the sampling rate. The third step may calculate, for the respective interpolation intervals, mapping parameters for performing mapping using an FIF on the mapping points. The fourth step may perform, in all of the interpolation intervals, the mapping using the FIF on the mapping points by using the mapping parameters according to the respective interpolation intervals, to thereby generate new sampling data items.

The sampling rate conversion method according to the aspect of the present embodiments may further include a step of storing sampling data items of respective division points which divide the audio signal portion into the plurality of interpolation intervals, and a step of inserting the generated new sampling data items between the sampling data items of the division points.

The sampling rate conversion method according to the aspect of the present embodiments may further include a step of dividing an input audio signal into the audio signal portion formed by the sampling data items having a predetermined length. In the method, the process of the first to fourth steps to increase the sampling rate may be performed with the audio signal portion set as a processing unit.

In the sampling rate conversion method according to the aspect of the present embodiments, when the sampling rate is multiplied by k, if k is an integer, the first step may set the intervals between the respective sampling data items as the interpolation intervals, and the second step may divide the sampling data items of the audio signal portion into a k number of equal portions to determine a k−1 number of the mapping points.

In the sampling rate conversion method according to the aspect of the present embodiments, when the sampling rate is multiplied by k, if k is not an integer but a fraction k1/k0, and if k1 is greater than k0, the first step may set the intervals between respective sampling data items obtained by down-sampling of the audio signal to a 1/k0-fold sampling rate as the interpolation intervals, and the second step may divide the sampling data items of the audio signal portion into a k1 number of equal portions to determine a k1−1 number of the mapping points.

In the sampling rate conversion method according to the aspect of the present embodiments, if the sampling data items of the audio signal portion cannot be divided into a k or k1 number of equal portions, the second step may determine the mapping points by performing a rounding process.

In the sampling rate conversion method according to the aspect of the present embodiments, in the calculation of the mapping parameters of the respective interpolation intervals by using the positions and the sampling data items of both ends of the audio signal portion and the positions and the sampling data items of both ends of each of the interpolation intervals, the third step may calculate the mapping parameters by making the difference in position between the both ends of the audio signal portion normalized to one.

Sampling Rate Conversion Apparatus:

A sampling rate conversion apparatus according to an aspect of the present embodiments may include an interpolation interval determination unit, a mapping point determination unit, a parameter determination unit, and an interpolation data generation unit. Additional, fewer, or alternative units may be provided. The interpolation interval determination unit may divide an audio signal portion formed by a predetermined number of sampling data items into a plurality of interpolation intervals. The mapping point determination unit may determine, on the audio signal portion, mapping points, the number of which is in accordance with the degree of increase in the sampling rate. The parameter determination unit may calculate, for the respective interpolation intervals, mapping parameters for performing mapping using an FIF on the mapping points. The interpolation data generation unit may perform, in all of the interpolation intervals, the mapping using the FIF on the mapping points by using the mapping parameters according to the respective interpolation intervals, to thereby generate new sampling data items.

The sampling rate conversion apparatus according to the aspect of the present embodiments may further include an interpolation interval storage unit which may store sampling data items of respective division points which divide the audio signal portion into the plurality of interpolation intervals, and an interpolation unit which may insert the generated new sampling data items between the sampling data items of the division points.

The sampling rate conversion apparatus according to the aspect of the present embodiments may further include a data division unit which may divide an input audio signal into the audio signal portion formed by the sampling data items having a predetermined length.

In the sampling rate conversion apparatus according to the aspect of the present embodiments, when the sampling rate is multiplied by k, if k is an integer, the interpolation interval determination unit may set the intervals between the respective sampling data items as the interpolation intervals, and the mapping point determination unit may divide the sampling data items of the audio signal portion into a k number of equal portions to determine a k−1 number of the mapping points.

In the sampling rate conversion apparatus according to the aspect of the present embodiments, when the sampling rate is multiplied by k, if k is not an integer but a fraction k1/k0, and if k1 is greater than k0, the interpolation interval determination unit may set the intervals between respective sampling data items obtained by downsampling of the audio signal to a 1/k0-fold sampling rate as the interpolation intervals, and the mapping point determination unit may divide the sampling data items of the audio signal portion into a k1 number of equal portions to determine a k1−1 number of the mapping points.

In the sampling rate conversion apparatus according to the aspect of the present embodiments, when the sampling data items of the audio signal portion cannot be divided into a k or k1 number of equal portions, the mapping point determination unit may determine the mapping points by performing a rounding process.

In the sampling rate conversion apparatus according to the aspect of the present embodiments, in the calculation of the mapping parameters of the respective interpolation intervals by using the positions and the sampling data items of both ends of the audio signal portion and the positions and the sampling data items of both ends of each of the interpolation intervals, the parameter determination unit may calculate the mapping parameters by making the difference in position between the both ends of the audio signal portion normalized to one.

The present embodiments may divide the audio signal portion formed by the predetermined number of sampling data items into the plurality of interpolation intervals, and may determine on the audio signal portion the mapping points, the number of which is in accordance with the degree of increase in the sampling rate. Further, in the respective interpolation intervals, the present embodiments may perform the mapping using the FIF on the mapping points by using the mapping parameters of the interpolation intervals, to thereby generate the new sampling data items. Therefore, there is no need to repeatedly perform the RIA process, unlike the related art. Accordingly, it is possible to reduce the number of mappings into the interpolation intervals, and thus to substantially reduce the throughput. As a result, the sampling speed can be increased in real time even in the case of an audio DSP.

The present embodiments may store the sampling data items of the respective division points which divide the audio signal portion into the plurality of interpolation intervals, and may insert the generated new sampling data items between the sampling data items of the division points. Therefore, a data string having an increased sampling speed can be output through an easy and efficient process.

The present embodiments may divide the input audio signal into the audio signal portion formed by the sampling data items having a predetermined length, and may perform the process of increasing the sampling rate with the audio signal portion set as the processing unit. Therefore, a data string having an increased sampling speed can be sequentially output in a short processing delay time.

When the sampling rate is multiplied by k, if k is an integer, the present embodiments may set the intervals between the respective sampling data items as the interpolation intervals. Further, the present embodiments may divide the sampling data items of the audio signal portion into the k number of equal portions to determine the k−1 number of the mapping points, and may perform the mapping using the FIF on the k−1 number of the mapping points in the respective interpolation intervals. Therefore, a data string having a sampling speed multiplied by k can be output through an easy and efficient process.

When the sampling rate is multiplied by k, if k is not an integer but a fraction k1/k0, the present embodiments may set the intervals between the respective sampling data items obtained by downsampling of the audio signal to a 1/k0-fold sampling rate as the interpolation intervals. Further, the present embodiments may divide the sampling data items of the audio signal portion into the k1 number of equal portions to determine the k1−1 number of the mapping points, and may perform the mapping using the FIF on the k1−1 number of the mapping points in the respective interpolation intervals. Therefore, a data string having a sampling speed multiplied by k can be output through an easy and efficient process, even if k is not an integer.

If the sampling data items of the audio signal portion cannot be divided in the k or k1 number of equal portions, the present embodiments may determine the mapping points by performing a rounding process. Therefore, the processing may be performed, even if the sampling data items cannot be accurately divided into equal portions. Further, the sampling data items may be substantially uniformly interpolated.

In the calculation of the mapping parameters of the respective interpolation intervals with the use of the positions and the sampling data items of both ends of the audio signal portion and the positions and sampling data items of both ends of each of the interpolation intervals, the present embodiments may calculate the mapping parameters by making the difference in position between the both ends of the audio signal portion normalized to one. Therefore, the time required for calculating the mapping parameters of the respective intervals may be reduced.

DESCRIPTION OF THE PREFERRED EMBODIMENTS

(A) Overview of the Present Invention

Figure 1:
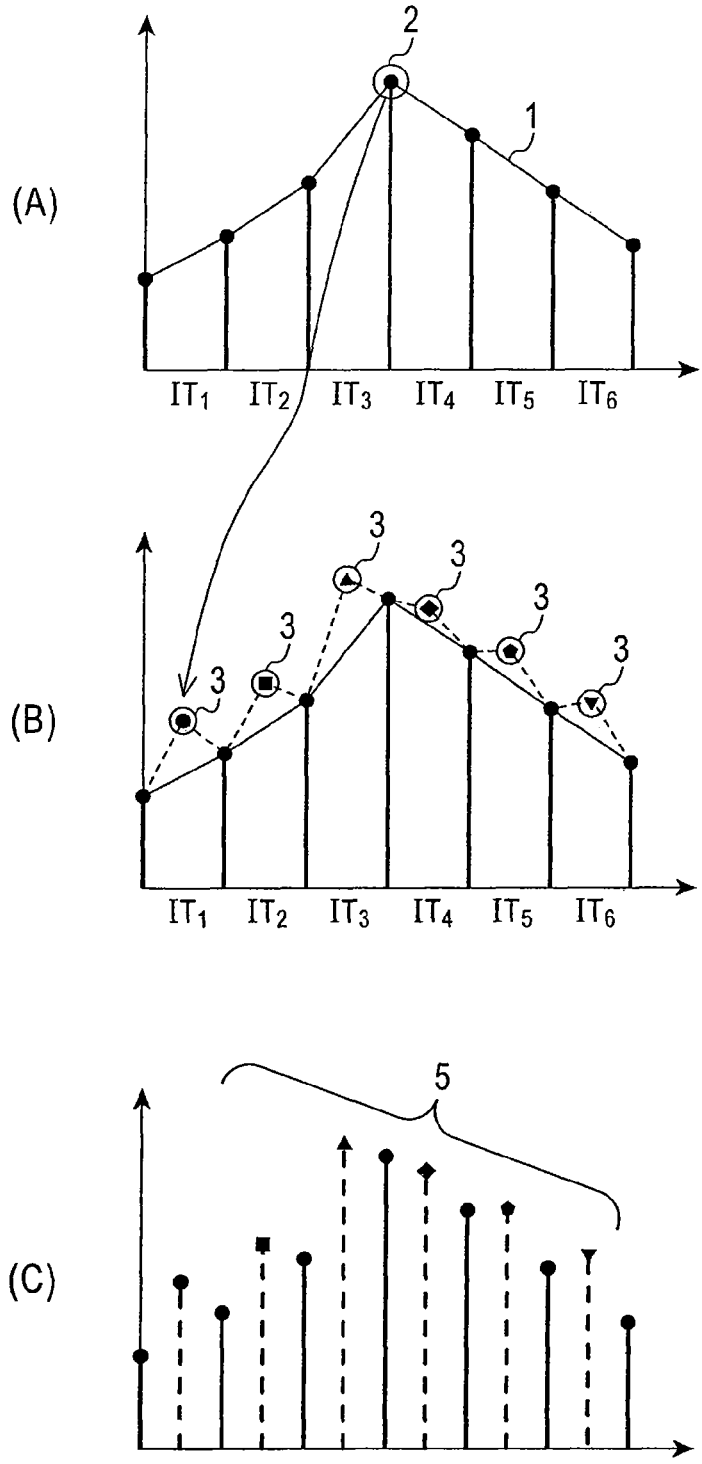
FIG. 1 is a schematic explanatory diagram of one exemplary embodiment (k=2)
Figure 2:
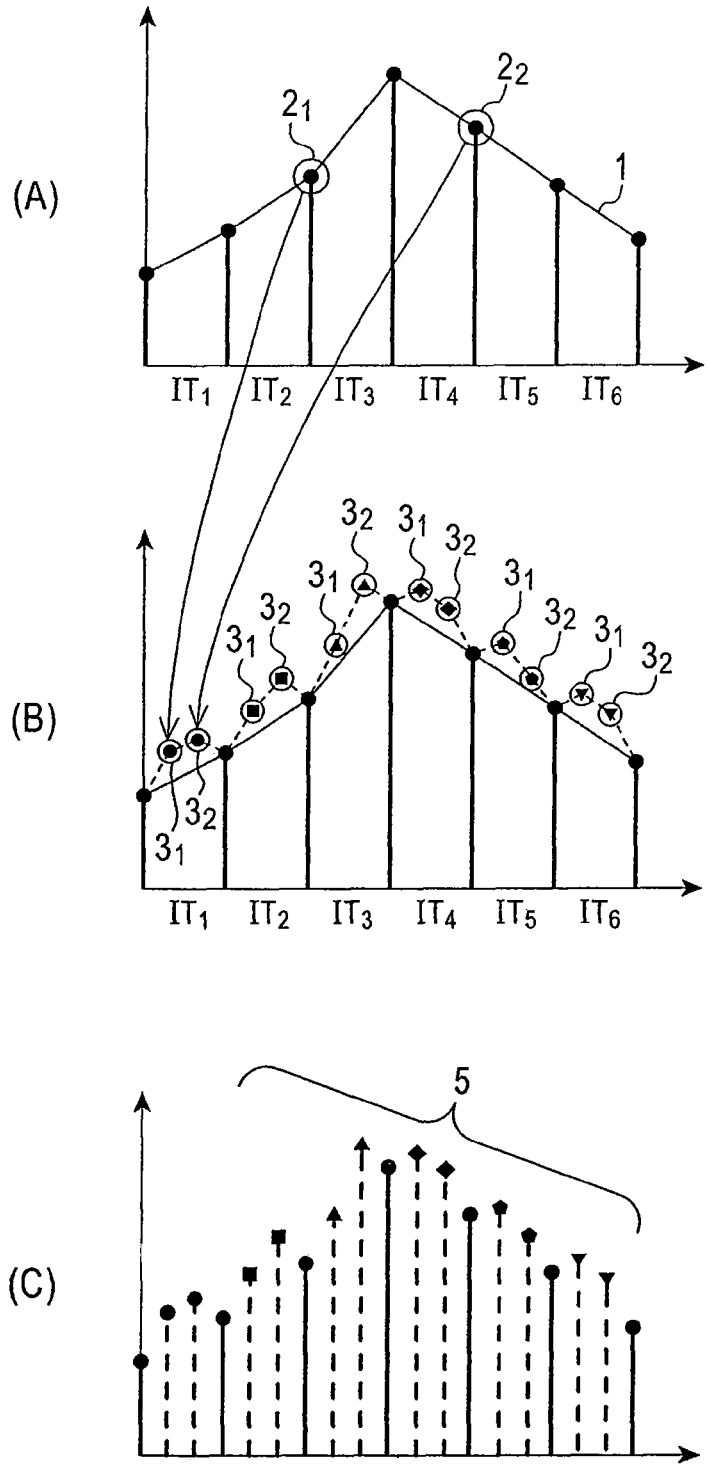
FIG. 2 is a schematic explanatory diagram of another exemplary embodiment (k=3)
Figure 3:
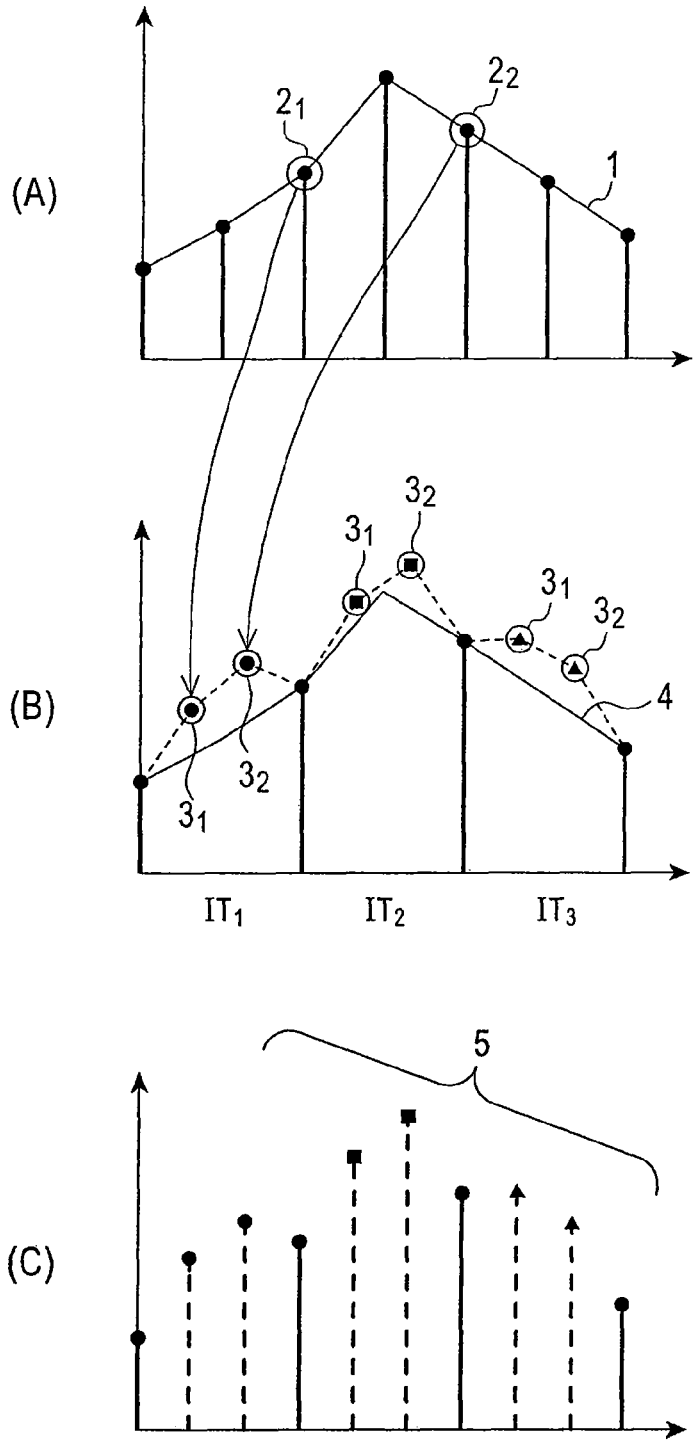
FIG. 3 is a schematic explanatory diagram of another exemplary embodiment (k=3/2)

FIGS. 1 to 3 are schematic diagrams of exemplary embodiments. FIG. 1 illustrates an example in which the sampling rate of a signal is multiplied by two. FIG. 2 illustrates an example in which the sampling rate of a signal is multiplied by three. FIG. 3 illustrates an example in which the sampling rate of a signal is multiplied by 1.5 (=3/2). The reference numeral 1 denotes an original signal obtained by division of input audio data into a predetermined length. The reference numerals 2, $\mathbf{2}_1$, and $\mathbf{2}_2$ denote contraction mapping points, and the reference numerals 3, $\mathbf{3}_1$, and $\mathbf{3}_2$ denote interpolation data items obtained by mapping using the FIF. The reference numeral 4 denotes a signal obtained by downsampling, and the reference numeral 5 denotes a signal having an increased sampling rate.

Upon input of discrete digital audio data, the input audio data is divided into sampling data items having a predetermined length (e.g., an N+1 number of sampling data items, wherein N=6 in the drawing), as illustrated in (A) of FIG. 1. Thereby, the original signal 1 is obtained. Then, the intervals between the respective sampling data items are set as interpolation intervals ITi (i=1, 2, . . . , 6). Thereafter, in accordance with a set magnification value k of the sampling rate (k=2 in this case), a predetermined sampling data item is determined as the contraction mapping point 2. In the case of k=2, the central sampling data item is determined as the contraction mapping point 2. Then, contraction mapping parameters of the respective interpolation intervals IT1 to IT6 are determined. On the basis of the mapping parameters, the mapping point 2 is mapped into each of the interpolation intervals to obtain the interpolation data items 3, and the interpolation data items 3 are inserted into the original signal 1, as illustrated in (B) of FIG. 1. Thereby, the signal 5 having a twofold increased sampling rate can be obtained, as illustrated in (C) of FIG. 1. Also in a case as illustrated in (A) to (C) of FIG. 2, in which the sampling rate is tripled, the two interpolation data items $\mathbf{3}_1$ and $\mathbf{3}_2$ are inserted into each of the interpolation intervals in a similar manner as in the case of doubling the sampling rate, to thereby triple the sampling rate. In this case, two sampling data items obtained by trisection of the original signal 1 are determined as the contraction mapping points $\mathbf{2}_1$ and $\mathbf{2}_2$, as illustrated in (A) of FIG. 2.

Further, if the magnification value k of the sampling rate is not an integer but is represented as k=k1/k0 (e.g., 3/2), the original signal 1 is downsampled to a 1/k0-fold, i.e., ½-fold sampling rate, as illustrated in (B) of FIG. 3. Then, the respective sampling data items obtained by the downsampling are determined as representative points, and the intervals between the sampling data items are set as interpolation intervals IT1 to IT3. Thereafter, in accordance with a value k1 (=3), predetermined sampling data items of the original signal 1 are determined as the contraction mapping points $\mathbf{2}_1$ and $\mathbf{2}_2$. In the case of k1=3, two sampling data items obtained by trisection of the original signal 1 are determined as the contraction mapping points $\mathbf{2}_1$ and $\mathbf{2}_2$, as illustrated in (A) of FIG. 3. Then, contraction mapping parameters of the respective interpolation intervals are determined. On the basis of the mapping parameters, the mapping points $\mathbf{2}_1$ and $\mathbf{2}_2$ are mapped into each of the interpolation intervals to generate the interpolation data items $\mathbf{3}_1$ and $\mathbf{3}_2$, and the interpolation data items $\mathbf{3}_1$ and $\mathbf{3}_2$ are inserted into the signal 4 obtained by the downsampling, as illustrated in (B) of FIG. 3. Thereby, the signal 5 having a 1.5-fold increased sampling rate can be obtained, as illustrated in (C) of FIG. 3.

(B) First Embodiment

Figure 4:
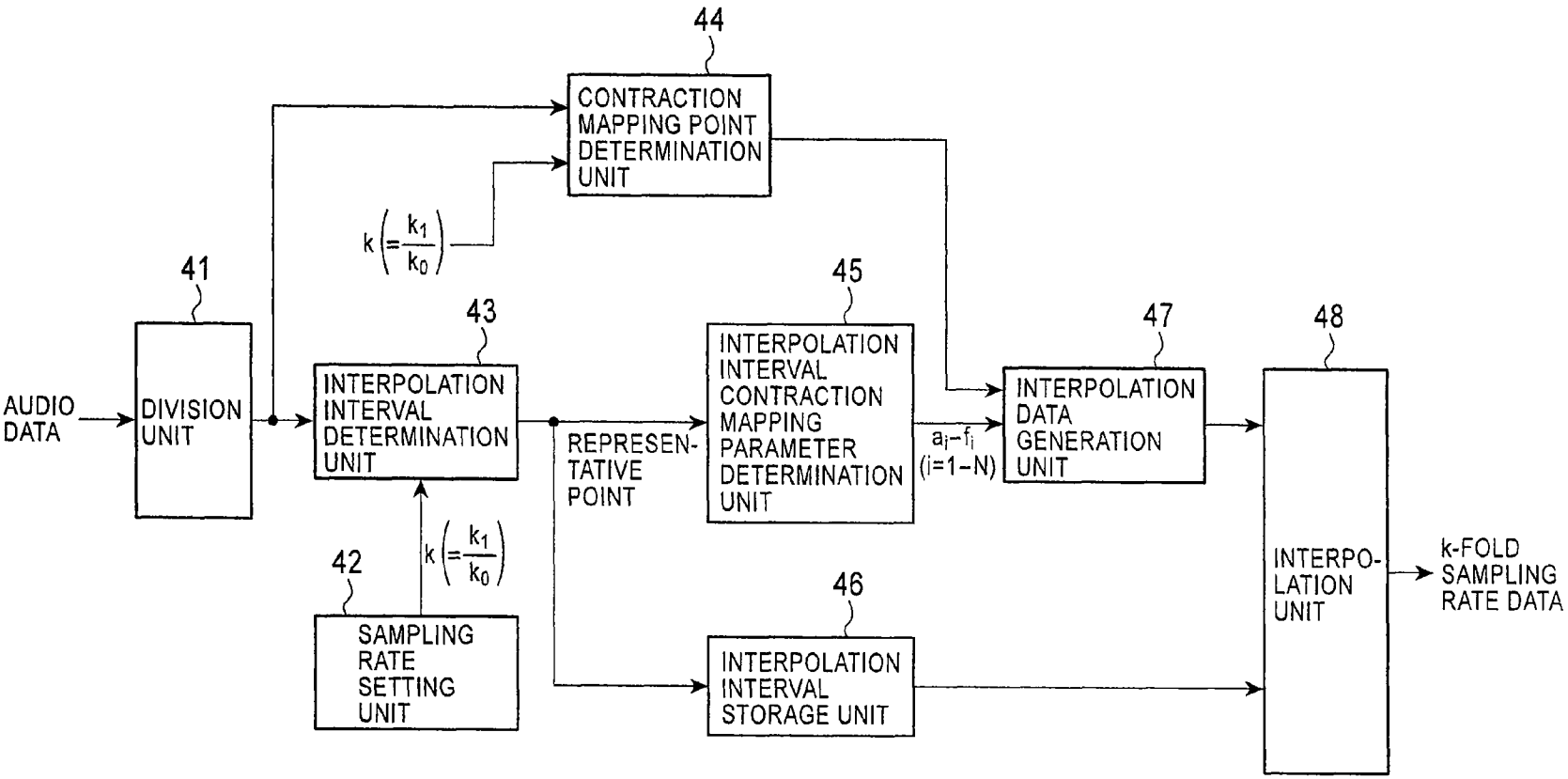
FIG. 4 is a configuration diagram of a sampling rate conversion apparatus according to a first exemplary embodiment.

FIG. 4 is a configuration diagram of a sampling rate conversion apparatus according to a first exemplary embodiment.

A division unit 41 divides an input discrete digital audio signal into an audio signal portion having a predetermined length (having an N+1 number of sampling data items).

A sampling rate setting unit 42 sets the sampling rate magnification value k for converting the sampling rate. Herein, it is assumed that the sampling rate setting unit 42 has set k1/k0 as the magnification value k.

On the basis of the magnification value k set by the sampling rate setting unit 42, an interpolation interval determination unit 43 determines the interpolation intervals. That is, if the magnification value k is an integer, the interpolation interval determination unit 43 determines the intervals between the respective sampling data items of the audio signal portion as the interpolation intervals. If the magnification value k is not an integer, the interpolation interval determination unit 43 downsamples the audio signal portion to the 1/k0-fold sampling rate, and sets the intervals between the sampling data items obtained by the downsampling as the interpolation intervals. The sampling data positions at both ends of each of the interpolation intervals are referred to as the representative points. Specifically, as illustrated in (B) of FIGS. 1 and 2, if the magnification value k is an integer, the interpolation interval determination unit 43 determines the respective sampling data positions of the audio signal portion as the representative points, and sets the intervals between the respective representative points (IT1 to IT6 in the drawings) as the interpolation intervals. If the magnification value k is not an integer (e.g., k=k1/k0=3/2), the interpolation interval determination unit 43 downsamples the audio signal portion to the 1/k0-fold sampling rate, as illustrated in (B) of FIG. 3. Then, the interpolation interval determination unit 43 determines the sampling data items obtained by the downsampling as the representative points, and sets the intervals between the respective representative points (IT1 to IT3 in the drawing) as the interpolation intervals.

On the basis of the magnification value k set by the sampling rate setting unit 42, a contraction mapping point determination unit 44 selects and determines a predetermined number of sampling data items of the audio signal portion as the contraction mapping points. That is, if the magnification value k is an integer, the contraction mapping point determination unit 44 sets a k−1 number of sampling data items obtained by division of the audio signal portion into the k number of equal portions as the contraction mapping points. If the magnification value k is not an integer, the contraction mapping point determination unit 44 sets a k1−1 number of sampling data items obtained by division of the audio signal portion into the k1 number of equal portions as the contraction mapping points. Specifically, a case in which the magnification value k is an integer (see FIGS. 1 and 2) and a case in which the magnification value k is not an integer (see FIG. 3) will be described. In the case of (A) of FIG. 1 (k=2), the audio signal portion is divided into two equal portions, and the contraction mapping point 2 is set as the contraction mapping point. In the case of (A) of FIG. 2 (k=3), the audio signal portion is divided into three equal portions, and the contraction mapping points $\mathbf{2}_1$ and $\mathbf{2}_2$ are set as the contraction mapping points. In the case of (A) of FIG. 3 (e.g., k=k1/k0=3/2), the audio signal portion is divided into three equal portions, and the contraction mapping points $\mathbf{2}_1$ and $\mathbf{2}_2$ are set as the contraction mapping points. If the audio signal portion cannot be divided into the k or k1 number of equal portions, sampling data items corresponding to the number obtained by rounding of mN/k (m=1, 2, . . . , k−1) or mN/k1 (m=1, 2, . . . , k1−1) are set as the contraction mapping points. The above-described process is referred to as the rounding process.

On the basis of Equations (6) to (9) and (16), an interpolation interval contraction mapping parameter determination unit 45 determines the contraction mapping parameters $a_i$, $c_i$, $d_i$, $e_i$, and $f_i$ (i=1 to N) of the respective interpolation intervals determined by the interpolation interval determination unit 43. Herein, if the time axis of the audio signal portion is normalized to one, Equations (6) to (9) and (16) can be transformed as follows.

Formula 16

$$a_i = x_i - x_{i-1} \tag{19}$$

$$e_i = x_{i-1} \tag{20}$$

$$c_i = y_i - y_{i-1} - d_i(y_M - y_0) \tag{21}$$

$$f_i = y_{i-1} - d_i \cdot y_0 \tag{22}$$

$$d_i = \frac{\sum_{n=0}^{N} \alpha_n \beta_n}{\sum_{n=0}^{N} \alpha_n^2} \tag{23}$$

wherein $$\alpha_n = v_n - (y_M - y_0)u_n - y_0 \tag{24}$$

$$\beta_n = v_m - (y_i - y_{i-1})u_n - y_{i-1} \tag{25}$$

According to Equations (19) to (25), $a_i$ has the same value in all of the intervals, and does not require division. Therefore, the contraction mapping parameters can be easily calculated.

An interpolation interval storage unit 46 stores the sampling data items of the representative points which identify the interpolation intervals determined by the interpolation interval determination unit 43.

Using the contraction mapping parameters $a_i$, $c_i$, $d_i$, $e_i$, and $f_i$ of the respective interpolation intervals determined by the interpolation interval contraction mapping parameter determination unit 45, an interpolation data generation unit 47 maps in the respective interpolation intervals the contraction mapping points determined by the contraction mapping point determination unit 44, to thereby determine the interpolation data items of the respective interpolation intervals. Specifically, in the case of k=2, the interpolation data generation unit 47 uses the contraction mapping point 2 in (A) of FIG. 1 and the contraction mapping parameters to generate the interpolation data items 3 in the interpolation intervals IT1 to IT6 in (B) of FIG. 1. In the case of k=3, the interpolation data generation unit 47 uses the contraction mapping points $\mathbf{2}_1$ and $\mathbf{2}_2$ in (A) of FIG. 2 and the contraction mapping parameters to generate the interpolation data items $\mathbf{3}_1$ (corresponding to the contraction mapping point $\mathbf{2}_1$) and $\mathbf{3}_2$ (corresponding to the contraction mapping point $\mathbf{2}_2$) in the interpolation intervals IT1 to IT6 in (B) of FIG. 2. Further, in the case of k=k1/k0=3/2, the interpolation data generation unit 47 uses the contraction mapping points $\mathbf{2}_1$ and $\mathbf{2}_2$ in (A) of FIG. 3 and the contraction mapping parameters to generate the interpolation data items $\mathbf{3}_1$ (corresponding to the contraction mapping point $\mathbf{2}_1$) and $\mathbf{3}_2$ (corresponding to the contraction mapping point $\mathbf{2}_2$) in the interpolation intervals IT1 to IT3 in (B) of FIG. 3.

Using the sampling data items of the representative points stored in the interpolation interval storage unit 46 and the interpolation data items of the respective interpolation intervals generated by the interpolation data generation unit 47, an interpolation unit 48 generates sampling data items having a k-fold increased sampling rate. Specifically, the interpolation unit 48 obtains the sampling-rate converted signal 5, in which the interpolation data items are inserted in the respective interpolation intervals ITi (i=1, 2, . . . , 6 in FIGS. 1 and 2, and i=1, 2, 3 in FIG. 3), as illustrated in (C) of FIGS. 1 to 3.

Subsequently, an overall operation will be described. Herein, it is assumed that the sampling rate setting unit 42 has set k (=k1/k0) as the sampling rate magnification value for converting the sampling rate.

Upon input of a discrete digital audio signal, the division unit 41 divides the input discrete digital audio signal into an audio signal portion having a predetermined length (having the N+1 number of sampling data items).

Then, on the basis of the magnification value k set by the sampling rate setting unit 42, the interpolation interval determination unit 43 determines the representative points and the interpolation intervals, and stores the representative points in the interpolation interval storage unit 46.

Thereafter, on the basis of the magnification value k set by the sampling rate setting unit 42, the contraction mapping point determination unit 44 determines a predetermined number, i.e., the k−1 or k1−1 number of sampling data items of the audio signal portion as the contraction mapping points.

Then, the interpolation interval contraction mapping parameter determination unit 45 determines the contraction mapping parameters of the respective interpolation intervals determined by the interpolation interval determination unit 43.

Then, using the contraction mapping parameters of the respective interpolation intervals, the interpolation data generation unit 47 maps in the respective interpolation intervals the contraction mapping points determined by the contraction mapping point determination unit 44, to thereby generate the interpolation data items of the respective interpolation intervals.

Lastly, using the sampling data items stored in the interpolation interval storage unit 46 and the interpolation data items of the respective interpolation intervals generated by the interpolation data generation unit 47, the interpolation unit 48 generates the sampling data items having a k-fold increased sampling rate.

(C) Second Embodiment

Description will be made of processing according to a second exemplary embodiment for converting the sampling rate by using an apparatus including a control unit such as a microcomputer.

Figure 5:
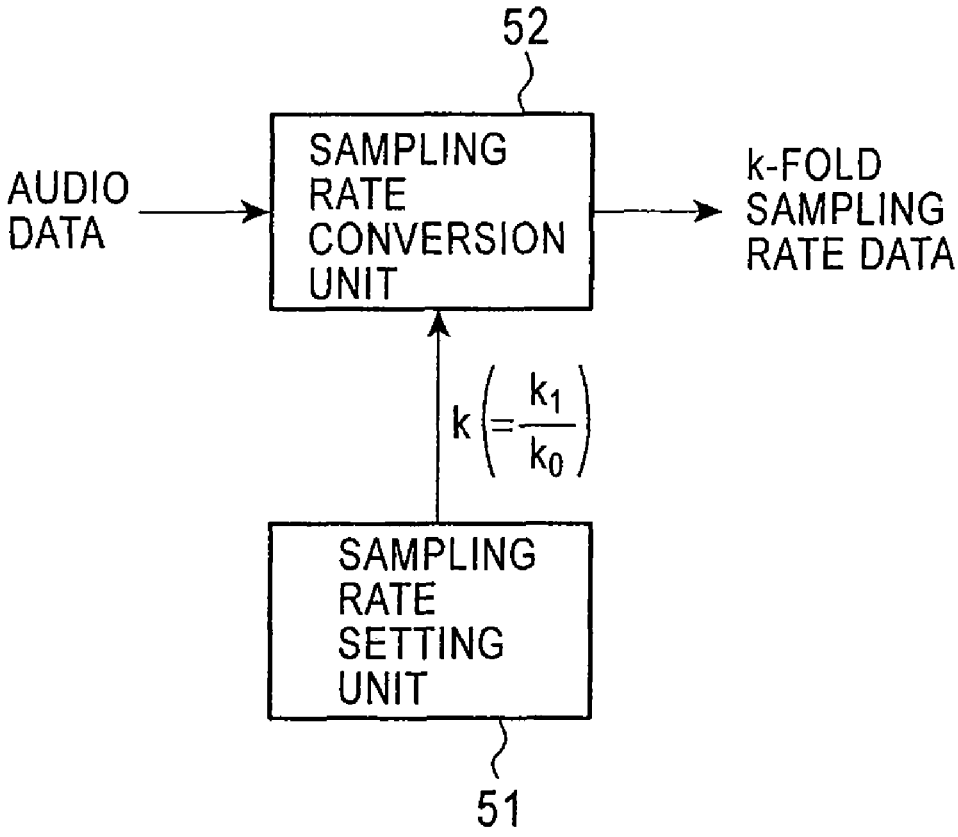
FIG. 5 is a configuration diagram of a sampling rate conversion apparatus according to a second exemplary embodiment.
Figure 6:
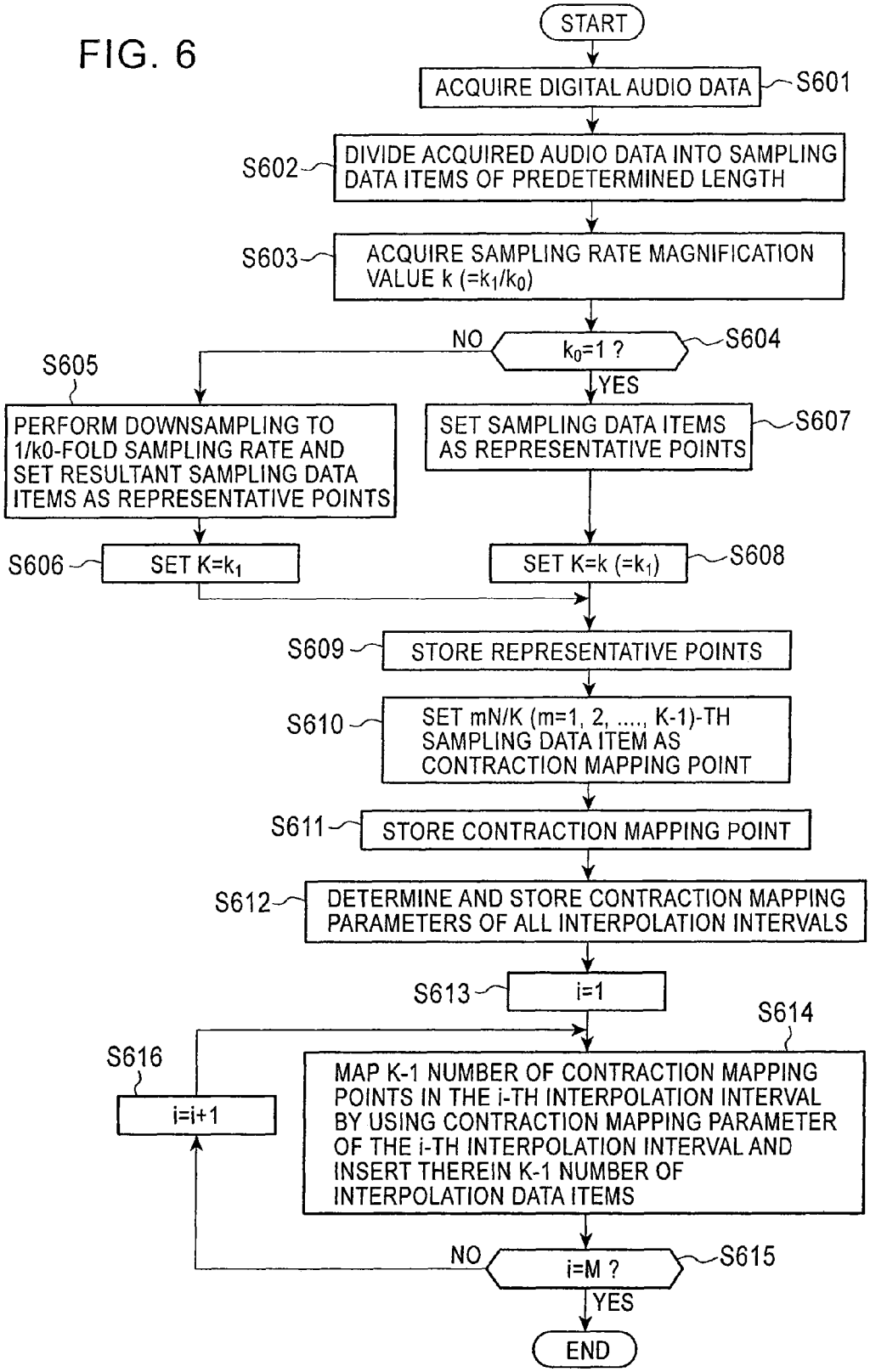
FIG. 6 is a process flowchart of sampling rate conversion according to an exemplary embodiment.
Figure 7:
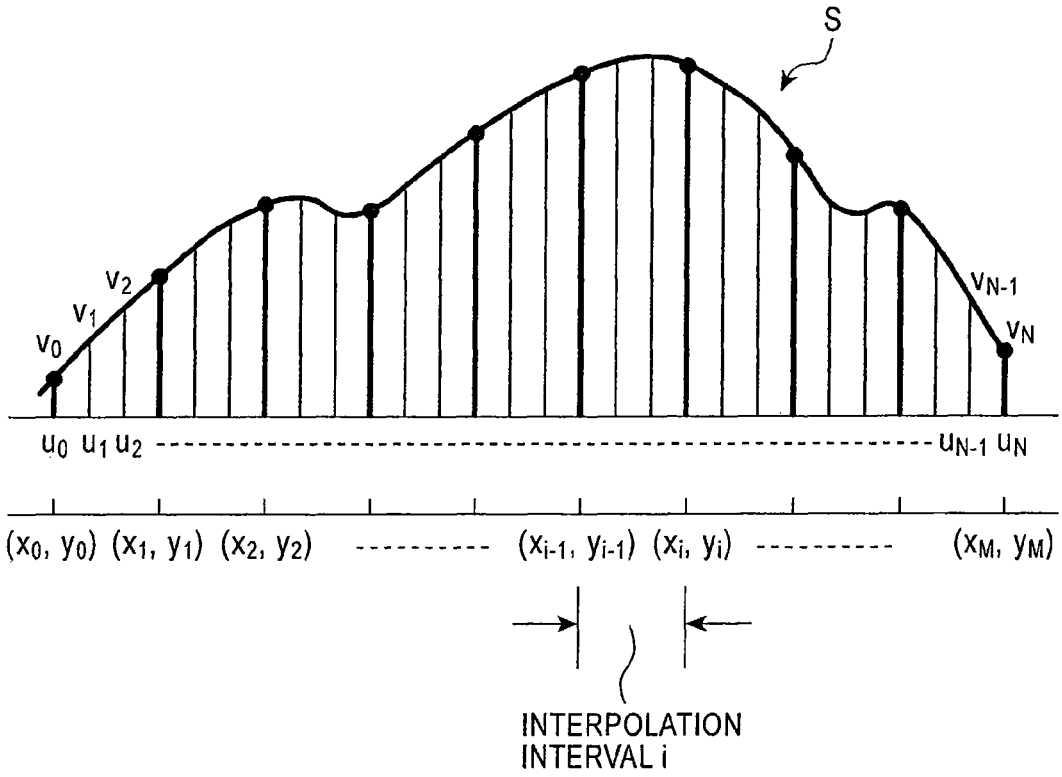
FIG. 7 is an explanatory diagram of an exemplary FIF processing procedure performed with a one-dimensional discrete signal.
Figure 8:
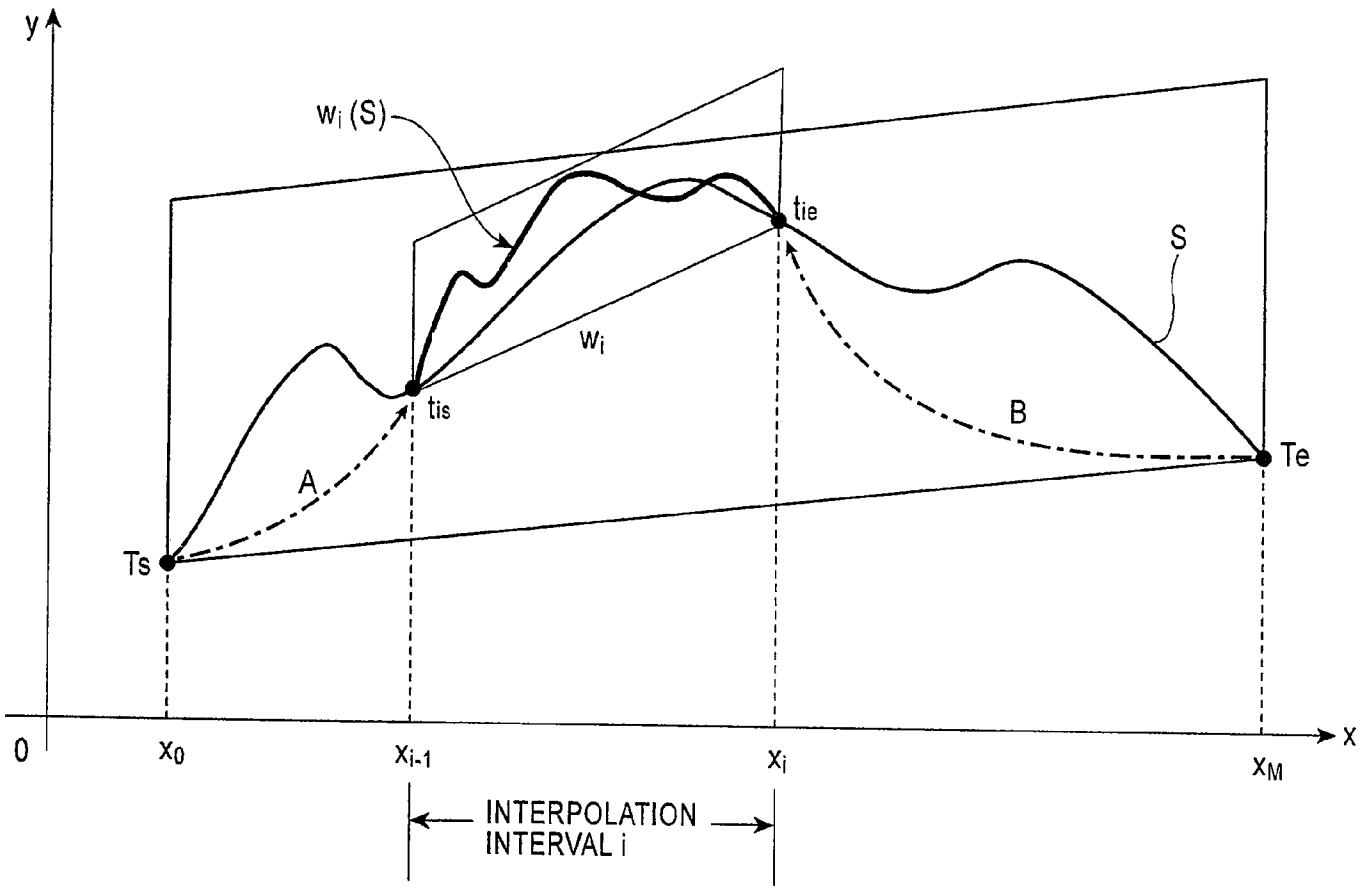
FIG. 8 illustrates an example in which the signal is mapped into an interpolation interval in the FIF processing procedure.
Figure 9:
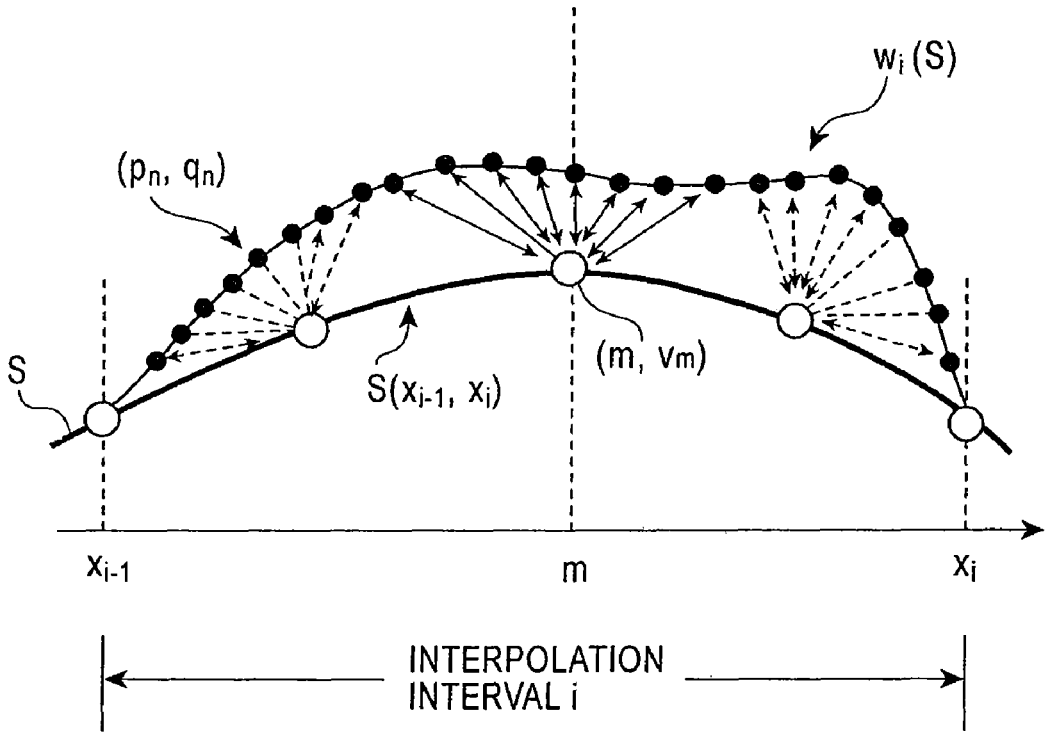
FIG. 9 is an explanatory diagram of a principle of determining mapping parameters by minimizing the error between the signal and a contracted image.
Figure 10:
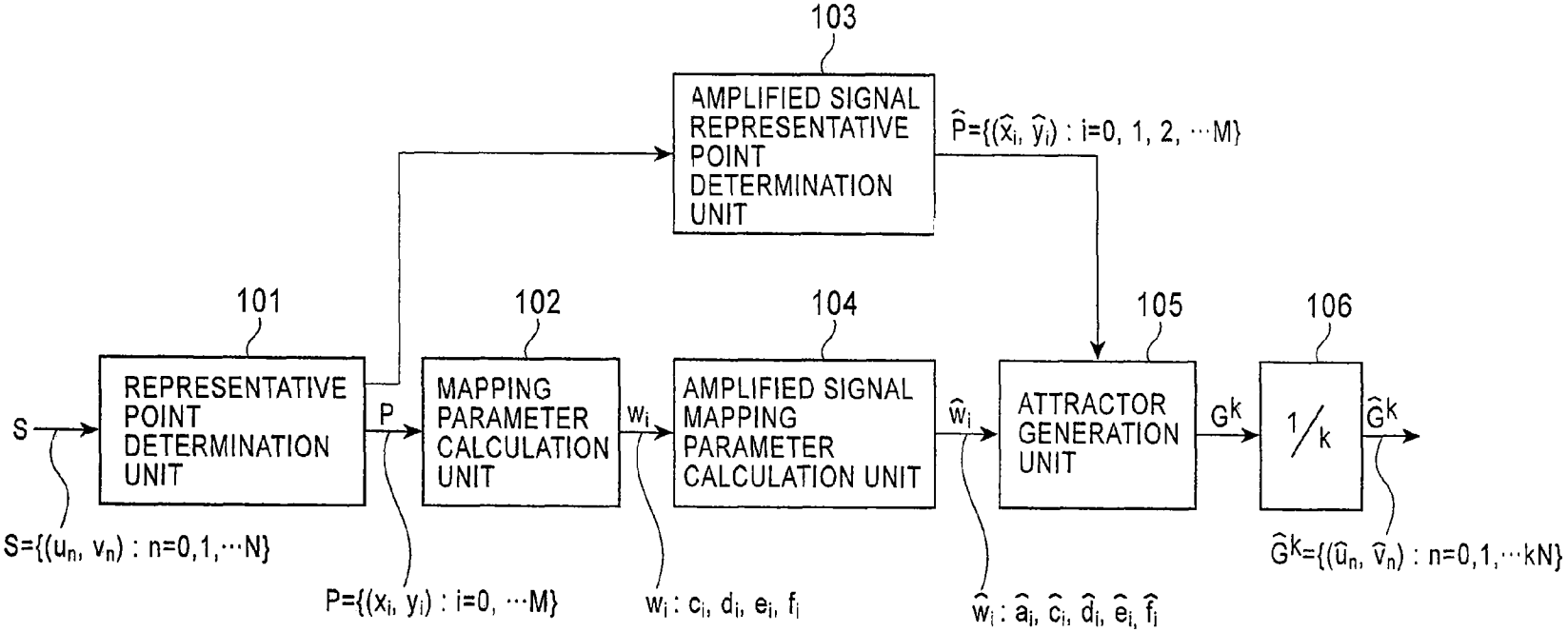
FIG. 10 is a configuration diagram of a sampling rate conversion apparatus according to a related art, which multiplies the sampling rate by k in accordance with a rate conversion algorithm using the FIF.

FIG. 5 is a configuration diagram of a sampling rate conversion apparatus of the second exemplary embodiment. FIG. 6 is a process flowchart of sampling rate conversion according to an exemplary embodiment. In FIG. 5, the reference numeral 51 denotes a sampling rate setting unit which sets the sampling rate magnification value, and the reference numeral 52 denotes a sampling rate conversion unit constituted by a microcomputer or a DSP to perform the sampling rate conversion process according to the exemplary embodiment. Description will be made below along the process flow of FIG. 6. Herein, it is assumed that the sampling rate setting unit 51 has set k (=k1/k0) as the sampling rate magnification value for converting the sampling rate.

The sampling rate conversion unit 52 acquires a discrete digital audio signal (Step S601), and divides the acquired audio signal into an audio signal portion having a predetermined length (having the N+1 number of sampling data items) (Step S602).

Then, the sampling rate conversion unit 52 acquires the sampling rate magnification value k (=k1/k0) set by the sampling rate setting unit 51 (Step S603), and determines whether or not the denominator k0 of the acquired sampling rate magnification value k (=k1/k0) is one (Step S604).

If the denominator k0 is not one, the sampling rate conversion unit 52 downsamples the sampling data items of the audio signal portion acquired at Step S602 to the 1/k0-fold sampling rate. Then, the sampling rate conversion unit 52 regards the sampling data items obtained by the downsampling as the representative points, and sets the intervals between the representative points as the interpolation intervals (Step S605). For example, in the case of k=k1/k0=3/2, the sampling rate conversion unit 52 downsamples the audio signal portion to the 1/k0-fold, i.e., ½-fold sampling rate, as illustrated in (B) of FIG. 3. Then, the sampling rate conversion unit 52 regards the sampling data items obtained by the downsampling as the representative points, and sets the intervals between the respective representative points (IT1 to IT3 in the drawing) as the interpolation intervals.

Then, the sampling rate conversion unit 52 sets K=k1 (Step S606), and the procedure proceeds to Step S609. Herein, K−1 represents the number of the contraction mapping points.

Meanwhile, if the sampling rate conversion unit 52 determines at Step S604 that the denominator k0 is one and that the magnification value k is an integer (k=k1=integer), the sampling rate conversion unit 52 regards the sampling data items of the audio signal portion as the representative points, and sets the intervals between the respective sampling data items as the interpolation intervals (Step S607). Specifically, as illustrated in (B) of FIGS. 1 and 2, if the magnification value k is an integer (k=k1/k0=2/1=2 or k=k1/k0=3/1=3), the sampling rate conversion unit 52 regards the sampling data positions of the audio signal portion as the representative points, and sets the intervals between the respective representative points (IT1 to IT6 in the drawings) as the interpolation intervals.

Then, the sampling rate conversion unit 52 sets K=k (Step S608), and the procedure proceeds to Step S609. That is, if the denominator k0 of the sampling rate magnification value k (=k1/k0) is not one, the sampling rate conversion unit 52 performs the processes of Steps S605 and S606. Meanwhile, if the denominator k0 is one, and if the magnification value k is an integer, the sampling rate conversion unit 52 performs the processes of Steps S607 and S608. Thereafter, the sampling rate conversion unit 52 stores the representative points which identify the respective interpolation intervals (Step S609).

Thereafter, the sampling rate conversion unit 52 divides the audio signal portion into the K number of equal portions, and sets a resultant K−1 number of sampling data items as the contraction mapping points (Step S610). Specifically, in the case of (A) of FIG. 1 (K=2), the sampling rate conversion unit 52 divides the audio signal portion into two equal portions, and sets the contraction mapping point 2. In the case of (A) of FIGS. 2 and 3 (K=3), the sampling rate conversion unit 52 divides the audio signal portion into three equal portions, and sets the contraction mapping points $\mathbf{2}_1$ and $\mathbf{2}_2$. If the audio signal portion cannot be divided into the K number of equal portions, the sampling rate conversion unit 52 sets, as the contraction mapping points, the sampling data items corresponding to the number obtained by rounding of mN/K (m=1, 2, . . . , K−1) performed in the previously described rounding process.

Then, the sampling rate conversion unit 52 stores the contraction mapping points set at Step S610 (Step S611).

The sampling rate conversion unit 52 then determines the contraction mapping parameters $a_i$, $c_i$, $d_i$, $e_i$, and $f_i$ (i=1 to N) of the respective interpolation intervals on the basis of Equations (6) to (9) and (16), and stores the contraction mapping parameters (Step S612). In the determination of the contraction mapping parameters, the sampling rate conversion unit 52 may determine the contraction mapping parameters by normalizing the length of the audio signal portion to a predetermined value (e.g., one) and using Equations (19) to (25).

Thereafter, the sampling rate conversion unit 52 sets i=1 (Step S613). Then, using the contraction mapping parameter of the i-th interpolation interval, the sampling rate conversion unit 52 maps the K−1 number of contraction mapping points in the i-th interpolation interval. Thereby, the sampling rate conversion unit 52 obtains and inserts the K−1 number of interpolation data items into the interpolation interval (Step S614). Specifically, in the case of (A) of FIG. 1 (K=2), the sampling rate conversion unit 52 uses the contraction mapping point 2 and the corresponding contraction mapping parameter to generate the interpolation data item 3 of the interpolation interval in (B) of FIG. 1, and inserts the interpolation data item 3 into the interpolation interval, as illustrated in (C) of FIG. 1. In the case of (A) of FIGS. 2 and 3 (K=3), the sampling rate conversion unit 52 uses the contraction mapping points $\mathbf{2}_1$ and $\mathbf{2}_2$ and the corresponding contraction mapping parameter to generate the interpolation data items $\mathbf{3}_1$ and $\mathbf{3}_2$ of the interpolation interval in (B) of FIGS. 2 and 3, and inserts the interpolation data items $\mathbf{3}_1$ and $\mathbf{3}_2$ into the interpolation interval, as illustrated in (C) of FIGS. 2 and 3.

The sampling rate conversion unit 52 repeatedly performs the process of Step S614 until the value i reaches the interpolation interval number M (Steps S615 and S616), to thereby insert the interpolation data items into the respective interpolation intervals and obtain the sampling-rate converted signal 5, as illustrated in (C) of FIGS. 1 to 3.

With the above-described configuration, in the case of k=k1/k0=3/2, for example, it is possible to perform upsampling to a 3/2-fold sampling rate in total by performing downsampling to a ½-fold the sampling rate and then performing upsampling to a threefold sampling rate. Further, in the case of k=k1/k0=3/1, it is possible to perform upsampling to a threefold sampling rate in total by performing upsampling to a threefold sampling rate without performing downsampling. Further, in the case of k=k1/k0=2/2, it is possible to supplement high-frequency components by performing downsampling to a ½-fold sampling rate and then performing upsampling to a twofold sampling rate. That is, it is possible to supplement the high-frequency components lost in a compressed audio signal by performing downsampling and then upsampling.

The sampling rate conversion using the FIF according to the present embodiments may convert a low sampling rate signal into a high sampling rate signal with low throughput, and may be effectively employed not only in the audio field but also in the image processing field.

As described above, the present embodiments may divide the audio signal portion formed by a predetermined number of sampling data items into a plurality of interpolation intervals, and may determine on the audio signal portion the mapping points, the number of which is in accordance with the degree of increase in the sampling rate. Further, in the respective interpolation intervals, the present embodiments may perform the mapping using the FIF on the mapping points by using the mapping parameters of the interpolation intervals, to thereby generate new sampling data items. Therefore, there is no need to repeatedly perform the RIA process, unlike the related art. Accordingly, it is possible to reduce the number of mappings into the interpolation intervals, and thus to substantially reduce the throughput. As a result, the sampling speed can be increased in real time even in the case of an audio DSP.

As is known in the art, the signals and/or data sampled and/or converted using the exemplary embodiments disclosed herein may be simultaneously or subsequently reproduced, such as either audio and/or video, using conventional techniques.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A computerized sampling rate conversion method accomplished via a processor which increases the sampling rate of a discrete audio signal sampled at a predetermined sampling rate by performing mapping using a fractal interpolation function, the computerized sampling rate conversion method comprising:

dividing an audio signal portion formed by a predetermined number of sampling data items into a plurality of interpolation intervals;

determining, on the audio signal portion, mapping points, the number of which is in accordance with the degree of increase in the sampling rate;

calculating, for the respective interpolation intervals, mapping parameters for performing the mapping using the fractal interpolation function on the mapping points; and performing, in all of the interpolation intervals, the mapping using the fractal interpolation function on the mapping points by using the mapping parameters according to the respective interpolation intervals, to thereby generate new sampling data items via the processor.

2. The computerized sampling rate conversion method according to claim 1, further comprising:

storing sampling data items of respective division points which divide the audio signal portion into the plurality of interpolation intervals; and inserting the generated new sampling data items between the sampling data items of the division points.

3. The computerized sampling rate conversion method according to claim 1, further comprising:

dividing the input audio signal into the audio signal portion formed by the sampling data items having a predetermined length, wherein the process of increasing the sampling rate is performed with the audio signal portion set as a processing unit.

4. The computerized sampling rate conversion method according to claim 1, wherein, when the sampling rate is multiplied by k, if k is an integer, the intervals between the respective sampling data items is set as the interpolation intervals, and wherein the sampling data items of the audio signal portion are divided into a k number of equal portions to determine a k−1 number of the mapping points.

5. The computerized sampling rate conversion method according to claim 1, wherein, when the sampling rate is multiplied by k, if k is not an integer but a fraction k1/k0, and if k1 is greater than k0, the intervals between respective sampling data items obtained by downsampling of the audio signal to a 1/k0-fold sampling rate is set as the interpolation intervals, and wherein the sampling data items of the audio signal portion are divided into a k1 number of equal portions to determine a k1-1 number of the mapping points.

6. The computerized sampling rate conversion method according to claim 4, wherein, if the sampling data items of the audio signal portion cannot be divided into a k or k1 number of equal portions, the mapping points are determined by performing a rounding process.

7. The computerized sampling rate conversion method according to claim 1, wherein, in the calculation of the mapping parameters of the respective interpolation intervals by using the positions and the sampling data items of both ends of the audio signal portion and the positions and the sampling data items of both ends of each of the interpolation intervals, the mapping parameters are calculated by making the difference in position between the both ends of the audio signal portion normalized to one.

8. A sampling rate conversion apparatus which increases the sampling rate of a discrete audio signal sampled at a predetermined sampling rate by performing mapping using a fractal interpolation function, the sampling rate conversion apparatus comprising:

an interpolation interval determination unit which divides an audio signal portion formed by a predetermined number of sampling data items into a plurality of interpolation intervals;

a mapping point determination unit which determines, on the audio signal portion, mapping points, the number of which is in accordance with the degree of increase in the sampling rate;

a parameter determination unit which calculates, for the respective interpolation intervals, mapping parameters for performing the mapping using the fractal interpolation function on the mapping points; and an interpolation data generation unit which performs, in all of the interpolation intervals, the mapping using the fractal interpolation function on the mapping points by using the mapping parameters according to the respective interpolation intervals, to thereby generate new sampling data items.

9. The sampling rate conversion apparatus according to claim 8, further comprising:

an interpolation interval storage unit which stores sampling data items of respective division points which divide the audio signal portion into the plurality of interpolation intervals; and an interpolation unit which inserts the generated new sampling data items between the sampling data items of the division points.

10. The sampling rate conversion apparatus according to claim 8, further comprising:

a data division unit which divides the input audio signal into the audio signal portion formed by the sampling data items having a predetermined length.

11. The sampling rate conversion apparatus according to claim 8, wherein, when the sampling rate is multiplied by k, if k is an integer, the interpolation interval determination unit sets the intervals between the respective sampling data items as the interpolation intervals, and wherein the mapping point determination unit divides the sampling data items of the audio signal portion into a k number of equal portions to determine a k−1 number of the mapping points.

12. The sampling rate conversion apparatus according to claim 8, wherein, when the sampling rate is multiplied by k, if k is not an integer but a fraction k1/k0, and if k1 is greater than k0, the interpolation interval determination unit sets the intervals between respective sampling data items obtained by downsampling of the audio signal to a 1/k0-fold sampling rate as the interpolation intervals, and wherein the mapping point determination unit divides the sampling data items of the audio signal portion into a k1 number of equal portions to determine a k1−1 number of the mapping points.

13. The sampling rate conversion apparatus according to claim 11, wherein, when the sampling data items of the audio signal portion cannot be divided into a k or k1 number of equal portions, the mapping point determination unit determines the mapping points by performing a rounding process.

14. The sampling rate conversion apparatus according to claim 8, wherein, in the calculation of the mapping parameters of the respective interpolation intervals by using the positions and the sampling data items of both ends of the audio signal portion and the positions and the sampling data items of both ends of each of the interpolation intervals, the parameter determination unit calculates the mapping parameters by making the difference in position between the both ends of the audio signal portion normalized to one.

15. A computerized sampling rate conversion method accomplished via a processor which increases the sampling rate of a discrete audio signal sampled at a predetermined sampling rate by performing mapping using a fractal interpolation function, the computerized sampling rate conversion method comprising:

determining mapping points along an audio signal portion, the number of mapping points being in accordance with the degree of increase in the sampling rate;

calculating, for a plurality of interpolation intervals along the audio signal portion, mapping parameters for performing the mapping using the fractal interpolation function on the mapping points; and performing, in all of the interpolation intervals, the mapping using the fractal interpolation function on the mapping points by using the mapping parameters according to the respective interpolation intervals, to thereby generate new sampling data items via the processor.

16. The computerized sampling rate conversion method of claim 15, further comprising dividing the audio signal portion, which is formed by a predetermined number of sampling data items, into a plurality of interpolation intervals.

* * * * *